US005804544A

United States Patent [19]

Powell et al.

[11] Patent Number: 5,804,544

[45] Date of Patent: Sep. 8, 1998

[54] GRANULAR DETERGENT COMPOSITION COMPRISING A SURFACTANT AND ANTIFOAMING COMPONENT

[75] Inventors: Suzanne Powell, Newcastle upon Tyne; Christiaan Arthur Thoen, Tyne & Wear, both of Great Britain

[73] Assignee: Procter & Gamble Company, Cincinnati, Ohio

[21] Appl. No.: 583,092

[22] PCT Filed: Jul. 7, 1994

[86] PCT No.: PCT/US94/07660

§ 371 Date: Jul. 5, 1996

§ 102(e) Date: Jul. 5, 1996

[87] PCT Pub. No.: WO95/02665

PCT Pub. Date: Jan. 26, 1995

[30] Foreign Application Priority Data

Jul. 12, 1993 [EP] European Pat. Off. ..... 93870132

[51] Int. Cl.[6] ..... C11D 1/12; C11D 3/08; C11D 3/20

[52] U.S. Cl. ..... 510/347; 510/466; 510/228; 510/350; 510/357; 510/352; 510/501; 510/474; 252/321; 252/358

[58] Field of Search ..... 252/321, 358; 510/466, 228, 347, 350, 351, 352, 501, 474

[56] References Cited

U.S. PATENT DOCUMENTS

| | | | |
|---|---|---|---|
| 3,933,672 | 1/1976 | Bartolotta et al. | 510/438 |
| 4,400,288 | 8/1983 | Dhanani et al. | 510/347 |
| 4,652,392 | 3/1987 | Baginski et al. | 510/438 |
| 4,732,694 | 3/1988 | Gowland et al. | 252/321 |
| 4,810,413 | 3/1989 | Pancheri et al. | 510/320 |
| 5,238,596 | 8/1993 | Smith | 510/441 |
| 5,376,301 | 12/1994 | Fleuren et al. | 510/278 |
| 5,456,855 | 10/1995 | De Cupere et al. | 510/441 |

FOREIGN PATENT DOCUMENTS

| | | |
|---|---|---|
| 0210731 | 2/1987 | European Pat. Off. . |
| 0495345 | 7/1992 | European Pat. Off. . |

*Primary Examiner*—Paul Lieberman
*Assistant Examiner*—Kery A. Fries
*Attorney, Agent, or Firm*—Richard S. Echler, Sr.; Kim W. Zerby; Brian M. Bolam

[57] ABSTRACT

A granular detergent composition is provided containing (a) from 3% to 30% by weight of the composition of a surfactant system containing from 30% to 100% by weight of the surfactant system of high-sudsing surfactant selected from alkyl sulfate, alkyl ethoxysulfate, polyhydroxy fatty acid amide surfactant, and mixtures thereof; (b) from 0.05% to 20% of the composition of a suds suppressing system comprising in combination (i) a spray on component, comprising antifoam compound and a carrier fluid wherein said spray-on component is incorporated into said granular detergent composition by being sprayed on to one or more of the granular components of the composition (ii) a particulate component, comprising in combination an antifoam compound and a water-soluble or water-dispersible carrier material, wherein said granular detergent composition is free from alkyl benzene sulfonate surfactant.

1 Claim, No Drawings

GRANULAR DETERGENT COMPOSITION COMPRISING A SURFACTANT AND ANTIFOAMING COMPONENT

This invention relates to granular detergent compositions suitable for use in cleaning processes, particularly fabric cleaning, and more especially to granular detergent compositions comprising high-foaming surfactant and no alkyl benzene sulfonate surfactant, wherein suds control is provided by a suds suppression system comprising in combination particulate and spray-on components.

Granular detergent compositions containing alkyl benzene sulfonate salts are well known in the art and are in widespread commercial use. Conventionally the alkyl benzene sulfonate salt forms part of a surfactant mixture in association with one or more other anionic or nonionic surfactants.

Interest has recently increased in the use of alternatives to alkyl benzene sulfonates as major components of detergent products.

Examples of primary surfactants that are readily biodegradable and which could replace the alkyl benzene sulfonate component either partially or in toto include alkyl sulfate, alkyl ethoxysulfate and polyhydroxy fatty acid amide surfactants. The high-sudsing nature of these surfactants is well known. Indeed, both alkyl ethoxysulfate and polyhydroxy fatty acid amide surfactants are known in the art, as surfactants for use in high-sudsing manual dishwashing compositions as represented for example by the composition disclosed in PCT Patent Application No. WO 92/06163. The high-sudsing characteristic presents a problem when these surfactants are to be included as major components of the surfactant system of detergent compositions for use in machine washing processes, such as machine laundering processes and machine dishwashing processes, where control of suds is required. The problem is particularly severe where the washing processes are carried out in high temperature and/or soft water conditions.

Suds suppression systems, particularly those utilising silicone antifoam compounds are well-known in the detergent art. The active suds suppressing components of such systems may be incorporated into granular detergent compositions, in a number of ways. For example the suds suppressing component may be dissolved or dispersed in an inert carrier liquid and then be sprayed on to the granular components of the detergent composition. Alternatively, the suds suppressing component may be present as a distinct particulate component of the granular composition. It is conventional for the suds suppressing component to be added as either a spray-on or as a distinct particulate.

The Applicants have found that where a granular detergent composition contains a high proportion of high-sudsing surfactant in the surfactant system a specific suds suppression system combining both spray-on and particulate components provides highly effective suds control, particularly in stressed high temperature/soft water wash conditions. Where only a spray-on component is employed, caking of the granular product can be a problem, particularly in view of the high levels of active suds suppressing components which need to be incorporated to combat the high-sudsing nature of the surfactants. Where all the suds suppression system contains only particulate components flash sudsing, that is high levels of sudsing which occur rapidly on dissolution of the detergent at the commencement of the wash process, can occur, especially when the particulate component releases the active suds suppressing component slowly into the wash solution.

According to one aspect of the present invention there is provided a granular detergent composition containing (a) from 1% to 30% by weight of the composition of a surfactant system containing from 30% to 100% by weight of the surfactant system of high-sudsing surfactant selected from alkyl sulfate, alkyl ethoxysulfate, polyhydroxy fatty acid amide surfactant and mixtures thereof;

(b) from 0.05% to 20% of the composition of a suds suppressing system comprising in combination (i) a spray on component, comprising antifoam compound and a carrier fluid wherein said spray-on component is incorporated into said granular detergent composition by being sprayed on to one or more of the granular components of the composition (ii) a particulate component, comprising in combination antifoam compound and a water-soluble or water-dispersible carrier material, wherein said granular detergent composition is free from alkyl benzene sulfonate surfactant.

The weight ratio of antifoam compound in the spray-on component to antifoam compound in the particulate component is preferably from 5:1 to 1:5, most preferably from 4:1 to 2:1.

The granular detergent compositions are suitable for use in essentially any washing, cleaning or laundering operation where suds control is required. In particular the compositions are suitable as machine laundering or dishwashing compositions.

The first essential component of the granular detergent compositions in accordance with the invention is a surfactant system present at a level of from 1% to 50%, preferably from 3% to 30%, more preferably from 5% to 15% by weight of the composition. It is an essential aspect of the invention that said surfactant system contains from 30% to 100% preferably 40% to 95%, most preferably 50% to 90% by weight of the surfactant system of high-sudsing surfactant, selected from alkyl sulfate, alkyl ethoxysulfate surfactant, polyhydroxy amide surfactant, and mixtures thereof.

By alkyl sulfate surfactant, which is an anionic surfactant, it is meant herein a $C_6$–$C_{20}$ alkyl sulfate surfactant, particularly a $C_{12}$–$C_{20}$ alkyl sulfate salt wherein the alkyl sulfate chain may be linear or branched, and the surfactant may be present as a salt formed with any suitable counter-cation, such as the alkali or alkaline metal or ammonium ions.

The $C_6$–$C_{20}$ alkyl sulfate salts may be derived from natural or synthetic hydrocarbon sources. Preferred examples of such salts include the substantially branched $C_{14}$–$C_{15}$ alkyl sulfate salts, that is where the degree of branching of the $C_{14}$–$C_{15}$ alkyl chain is greater than about 20%. Such substantially branched $C_{14}$–$C_{15}$ alkyl sulfate salts are usually derived from synthetic sources. Also preferred are $C_{12}$–$C_{20}$ alkyl sulfate salts which are derived from natural sources such as tallow fat coconut oil and marine oils.

By alkyl ethoxysulfate surfactant, which is an anionic surfactant, it is meant herein a water soluble alkyl ethoxysulfate surfactant, particularly a $C_{11}$–$C_{18}$ alkyl ethoxysulfate salt containing an average of from 1 to 7 ethoxy groups per mole.

The $C_{11}$–$C_{18}$ alkyl ethoxysulfate salt comprises a primary alkyl ethoxysulfate which is derived from the condensation product of a $C_{11}$–$C_{18}$ alcohol condensed with an average of from one to seven ethylene oxide groups, per mole. Preferred are the $C_{12}$–$C_{15}$ alkyl ethoxysulfate salts with an average of from one to five ethoxy groups per mole, and most preferably with an average of from one to three ethoxy groups per mole.

The $C_{11}$–$C_{18}$ alcohol itself can be obtained from natural of synthetic sources. Thus, $C_{11}$–$C_{18}$ alcohols, derived from natural fats, or Ziegler olefin build-up, or OXO synthesis can form suitable sources for the alkyl group. Examples of synthetically derived materials include Dobanol 25 (RTM) sold by Shell Chemicals (UK)Ltd which is a blend of $C_{12}$–$C_{15}$ alcohols, Ethyl 25 sold by the Ethyl Corporation, a blend of $C_{12}$–$C_{15}$ alcohols in the ratio 67% $C_{13}$, 33% $C_{15}$ sold under the trade name Lutensol by BASF gmbH and Synperonic (RTM) by ICI Ltd., and Lial 125 sold by Liquichimica Italiana. Examples of naturally occuring materials from which the alcohols can be derived are coconut oil and palm kernel oil and the corresponding fatty acids.

The alkyl ethoxysulfate salt is preferably incorporated into the surfactant system of the compositions of the invention of the invention at a level of from 1% to 40% by weight of the surfactant system, most preferably in combination with an alkyl sulfate surfactant. The weight ratio of the alkyl sulfate surfactant to the alkyl ethoxysulfate surfactant in the surfactant system is preferably from 2:1 to 19:1 more preferably from 3:1 to 12:1 and most preferably from 3.5:1 to 10:1. The level of alkyl ethoxysulfate surfactant in any particulate component of the granular detergent composition of the invention is preferably from 0.25% to 10% more preferably from 0.5% to 5% and most preferably from 1% to 3% by weight of the component.

By polyhydroxy fatty acid amide surfactant, which is a nonionic surfactant, it is meant herein a compound of the structural formula:

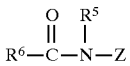

wherein: $R^5$ is H, $C_1$–$C_4$ hydrocarbyl, 2-hydroxy ethyl, 2-hydroxypropyl, or a mixture thereof, preferably $C_1$ or $C_2$ alkyl, most preferably $C_1$ alkyl (ie. methyl); and $R^6$ is a $C_{11}$–$C_{31}$ hydrocarbyl, preferably straight chain $C_{11}$–$C_{19}$ alkyl, or alkanyl most preferably straight chain $C_{15}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose.

As raw materials, high dextrose corn syrup, high fructose corn syrup, and high maltose corn syrup can be utilised as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —CH($CH_2OH$)—$(CHOH)_{n-1}$—$CH_2OH$, i—$CH_2$—$(CHOH)_2$(CHOR')(CHOH)—$CH_2OH$, where n is an integer from 3 to 5, inclusive, and R' is H or a cyclic or aliphatic monosaccharide, and alkoxylated derivatives thereof. Most preferred are glycityls wherein n is 4, particularly —$CH_2$—$(CHOH)_4$—$CH_2OH$.

$R^5$ can be, for example, N-methyl, N-ethyl, N-propyl, N-isopropyl, N-butyl, N-2-hydroxy ethyl, or N-2-hydroxypropyl.

$R^6$—CO—N<can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The most preferred polyhydroxy fatty acid amide has the general formula

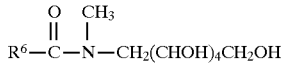

wherein $R^6$ is a $C_{11}$–$C_{19}$ straight-chain alkyl or alkenyl group.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in GB Patent Specification 809 060, published Feb. 18, 1959, by Thomas Hedley & Co Ltd, U.S. Pat. No. 2,965,576, issued Dec. 20, 1960 to E R Wilson, and U.S. Pat. No. 1,985,424, issued Dec. 25, 1934 to Piggott, each of which is incorporated herein by reference.

It is preferable that the alkyl sulfate surfactant or polyhydroxy fatty acid amide surfactant and the alkyl ethoxysulfate surfactant are in intimate admixture, that is they should be mixed prior to the formation of the granular component. In the case of a spray dried granule, this mixing can take place in the slurried mixture fed to the spray drying equipment. Where another type of the granule is formed an intimate mixture of the surfactants should be made before agglomeration, milling, flaking, prilling or any other particulate forming process takes place.

The surfactant system of the compositions of the invention may also contain surfactants other than the alkyl sulfate, alkyl ethoxysulfate or polyhydroxy fatty acid amide surfactant at a level of from 0% to 70% by weight of the surfactant system. These surfactants may be anionic, nonionic, cationic, zwitterionic or amphoteric in nature.

Use of alkane sulfonate salts as anionic surfactants is well known in the art, being disclosed for example in U.S. Pat. No. 3,929,678. Aliphatic alkane sulfonate salts may be obtained from the reaction of an aliphatic hydrocarbon, which may include the iso-, neo-, meso- and n-paraffins, having 12 to 24 carbon atoms and a sulfonating agent which may for example be $SO_3$, $H_2SO_4$ or oleum the reaction being carried out according to known sulfonation methods, including bleaching and hydrolysis. In accord with the present invention the aliphatic $C_{12}$–$C_{20}$ alkane sulfonate salts are preferred with the aliphatic $C_{14}$–$C_{20}$ alkane sulfonate salts being most preferred. Preferred as cations are the alkali metal and ammonium cations.

Alkyl ester sulfonate surfactants hereof include linear esters of $C_{12}$–$C_{20}$ carboxylic acids (ie. fatty acids) which are sulfonated with gaseous $SO_3$ according to "The Journal of the American Oil Chemists Society," 52 (1975), pp. 323–329. Suitable starting materials include natural fatty substances as derived from tallow, palm oil, etc.

The preferred alkyl ester sulfonate surfactants in accord with the invention comprise methyl ester sulfonate surfactants of the structural formula:

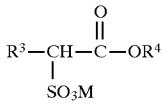

wherein $R^3$ is a $C_{12}$–$C_{20}$ alkyl, $R^4$ is methyl and M is a cation which forms a salt with the methyl ester sulfonate. Suitable salt-forming cations include metals such as sodium, potassium, and lithium, and substituted or unsubstituted ammonium cations, such as monoethanolamine, diethanolamine, and triethanolamine. Most preferably, $R^3$ is $C_{14}$–$C_{20}$ alkyl.

The second essential component of the granular detergent compositions of the invention is a suds suppressing system present at a level of from 0.05% to 20%, preferably from 1% to 10%, most preferably from 2% to 8% by weight of the composition. The suds suppressing system comprises in combination a spray-on component and a particulate component.

The spray-on component of the suds suppressing system is characterized by its fluid nature and by its method of incorporation into the granular detergent composition, namely by a spraying on process.

The spray-on component comprises in combination an antifoam compound and a carrier fluid and optionally a dispersant compound. The antifoam compound is dissolved, dispersed, suspended or emulsified in said carrier fluid. The carrier fluid should be inert in nature, that is it should not undergo undesirable chemical reaction with the antifoam compound, and also preferably be storage stable under normal atmospheric conditions and in the environment of a granular detergent matrix.

The spray-on component is incorporated into the granular detergent compositions of the invention by a spray-on process, that is a process whereby the liquid is sprayed on to some or all of the individual granular components of the composition. Highly preferably the spray-on process will be such as to provide a uniform and sufficient application of the suds suppressing component to any granular components of the composition which comprise a high sudsing surfactant.

A preferred composition for the spray-on component comprises (a) antifoam compound, preferably silicone antifoam compound, most preferably a silicone antifoam compound comprising in combination (i) polydimethyl siloxane, at a level of from 50% to 99%, preferably 75% to 95% by weight of the silicone antifoam compound; and (ii) silica, at a level of from 1% to 50%, preferably 5% to 25% by weight of the silicone/silica antifoam compound; wherein said silica/silicone antifoam compound is incorporated at a level of from 5% to 50%, preferably 10% to 40% by weight of the spray-on component;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight of the spray-on component; a particularly preferred silicone glycol rake copolymer of this type is DCO544 (trade name), commercially available from DOW Corning.

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight of the spray-on component;

The spray on component of the suds suppressing system may be incorporated as such, or in a preferred execution may be mixed with other components such as liquid nonionic surfactants, and perfume, and this mixture sprayed on as a whole.

The particulate component of the suds suppressing system is characterized by its particulate form and by its incorporation into the compositions of the invention in this form.

By particulate form it is meant essentially any of the particulate forms which may be typically adapted by a component of a granular detergent composition. The particulate component can therefore be, for example, in the form of granules, flakes, prills, marumes or noodles. In a preferred execution the particulate is granular in nature. Granules themselves may be agglomerates formed by pan or drum agglomeration or by an in-line mixer, and also may be spray-dried particles produced by atomising an aqueous slurry of the ingredients in a hot air stream which removes most of the water. The spray dried granules are then subjected to densification steps, eg : by high speed cutter mixers and/or compacting mills, to increase density before being reagglomerated.

The particulate component of the suds suppressing system comprises in combination antifoam compound, and a carrier material which is highly preferably water-soluble or water-dispersible in nature.

A suitable particulate antifoam component useful in the compositions herein comprises a mixture of an alkylated siloxane of the type hereinabove disclosed and solid silica.

The solid silica can be a fumed silica, a precipitated silica or a silica, made by the gel formation technique. The silica particles suitable have an average particle size of from 0.1 to 50 micrometers, preferably from 1 to 20 micrometers and a surface area of at least 50 $m^2/g$. These silica particles can be rendered hydrophobic by treating them with dialkylsilyl groups and/or trialkylsilyl groups either bonded directly onto the silica or by means of a silicone resin. It is preferred to employ a silica the particles of which have been rendered hydrophobic with dimethyl and/or trimethyl silyl groups. A preferred particulate antifoam compound for inclusion in the detergent compositions in accordance with the invention suitably contain an amount of silica such that the weight ratio of silica to silicone lies in the range from 1:100 to 3:10, preferably from 1:50 to 1:7.

Another suitable particulate antifoam component is represented by a hydrophobic silanated (most preferably trimethyl-silanated) silica having a particle size in the range from 10 nanometers to 20 nanometers and a specific surface area above 50 $m^2/g$, intimately admixed with demethyl silicone fluid having a molecular weight in the range from about 500 to about 200,000 at a weight ratio of silicone to silanated silica of from about 1:1 to about 1:2.

Suitable particulate antifoam components are disclosed in Bartollota et al. U.S. Pat. No. 3,933,672.

A highly preferred particulate antifoam component is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate antifoam components wherein the organic carrier material is a fatty acid or alcohol having a carbon chain containing from 12 to 20 carbon atoms, or a mixture thereof, with a melting point of from 45° C. to 80° C.

Other highly preferred particulate antifoam components are described in copending European Application 91870007.1 in the name of the Procter and Gamble Company which components comprise silicone antifoam compound, a carrier material, an organic coating material and glycerol at a weight ratio of glycerol : silicone antifoam compound of 1:2 to 3:1. Copending European Application 91201342.0 also discloses highly preferred particulate antifoam components comprising silicone antifoam compound, a carrier material, an organic coating material and crystalline or amorphous aluminosilicate at a weight ratio of aluminosilicate: silicone antifoam compound of 1:3 to 3:1. The preferred carrier material in both of the above described highly preferred granular suds controlling agents is starch.

An exemplary particulate antifoam component for use herein is a particulate agglomerate component, made by an agglomeration process, comprising in combination (i) from 5% to 30%, preferably from 8% to 15% by weight of the component of silicone antifoam compound, preferably comprising in combination polydimethyl siloxane and silica;

(ii) from 50% to 90%, preferably from 60% to 80% by weight of the component, of carrier material, preferably starch;

(iii) from 2% to 30%, preferably from 5% to 20% by weight of the component of agglomerate binder compound, where herein such compound can be any compound, or mixtures thereof typically employed as binders for agglomerates, most preferably said agglomerate binder compound comprises a $C_{16}$–$C_{18}$ ethoxylated alcohol with a degree of ethoxylation of from 50 to 100; and (iv) from 0% to 15%, preferably from 1% to 10%, by weight of $C_{12}$–$C_{22}$ hydrogenated fatty acid.

The incorporation of silicone antifoam compounds as components of seperate particulate components also permits the inclusion therein of $C_{20}$–$C_{24}$ fatty acids, microcrystalline waxes and high MWt copolymers of ethylene oxide and propylene oxide which would otherwise adversely affect the despersibility of the matrix. Techniques for forming such particulates are disclosed in U.S. Pat. No. 3,933,672.

A preferred suds suppressing system in accord with the invention has the weight ratio of antifoam compound comprised in the spray-on component to antifoam compound comprised in the particulate component of from 5:1 to 1:5, most preferably from 4:1 to 2:1.

Antifoam compound is a required element of both the spray on and particulate components of the suds suppressing system. By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types.

Preferred silicone antifoam compounds are the siloxanes having the general structure:

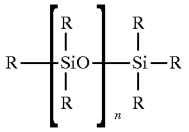

where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end-blocking units and having a viscosity at 25° C. of from $5\times10^{-5}m^2/s$ to $0.1m^2/s$ i.e. a value on n in the range 40 to 1500. These are preferred because of their ready availability and their relatively low cost.

Other suitable antifoam compounds include the monocarboxylic fatty acids and soluble salts thereof. These materials. are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight hydrocarbons such as paraffin, fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, and monostearyl di-alkali metal (e.g. sodium, potassium, lithium) phosphates and phosphate esters. The hydrocarbons, such as paraffin and haloparaffin, can be utilized in liquid form. The liquid hydrocarbons will be liquid at room temperature and atmospheric pressure, and will have a pour point in the range of about −40° C. and about 5° C., and a minimum boiling point not less than 110° C. (atmospheric pressure). It is also known to utilize waxy hydrocarbons, preferably having a melting point below about 100° C. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin", as used in this suds supressor dicussion, is intended to include mixtures of true paraffins and cyclic hydrocarbons.

Copolymers of ethylene oxide and propylene oxide, particularly the mixed ethoxylated/propoxylated fatty alcohols with an alkyl chain length of from 10 to 16 carbon atoms, a degree of ethoxylation of from 3 to 30 and a degree of propoxylation of from 1 to 10, are also suitable antifoam compounds for use herein.

Optional ingredients

The compositions of the invention optionally comprise other ingredients which are typically found as components of granular detergent compositions.

A highly preferred optional ingredient is a builder system comprising one or more inorganic and/or organic builder salts. The builder system will typically comprise from 1% to 80%, preferably 5% to 60%, most preferably from 20% to 60% by weight of the granular detergent compositions.

The inorganic and/or organic builder salts may be water-soluble or water-insoluble and can include, but are not restricted to alkali metal carbonates, crystalline layered sodium silicates, bicarbonates, silicates, aluminosilicates, monomeric polycarboxylates, homo or copolymeric polycarboxylic acids or their salts in which the polycarboxylic acid comprises at least two carboxylic radicals separated from each other by not more than two carbon atoms, organic phosphonates and aminoalkylene poly (alkylene phosphonates) and mixtures of any of the foregoing.

The builder salt is preferably present in any individual particulate components of the composition in an amount from 15% to 95% by weight.

If the particulate component of the composition is a spray dried granule the builder salt component is present more preferably in an amount from 25% to 85% by weight of the particulate and if the particulate component is a particulate agglomerate more preferably in an amount from 20% to 85% by weight of the particulate.

Preferred builder systems are free of boron compounds and any polymeric organic materials are preferably biodegradable.

Suitable silicates are those having an $SiO_2$:$Na_2O$ ratio in the range from 1.6 to 3.4, the so-called amorphous silicates of $SiO_2$:$Na_2O$ ratios from 2.0 to 2.8 being employed where addition to the mixture of ingredients that are spray dried is required. Where aluminosilicates constitute an ingredient of the mixture to be spray dried, silicates should not be present in the mixture but can be incorporated in the form of an aqueous solution serving as an agglomerating agent for other solid components, or, where the silicates are themselves in particulate form, as solids to the other particulate components of the composition. However, for compositions in which the percentage of spray dried components is low i.e. 30%, it is preferred to include the amorphous silicate in the spray-dried components.

Whilst a range of aluminosilicate ion exchange materials can be used, preferred sodium aluminosilicate zeolites have the unit cell formula $$Na_z[(AlO_2)_z(SiO_2)_y]xH_2O$$

wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/gallon/minute/gram/gallon)] of aluminosilicate (anhydrous basis), and which generally lies within the range of from 130 mg equivalent of $CaCO_3$/liter/minute/(gram/liter) [2 grains/gallon/minute/(gram/gallon)] to 390 mg equivalent of $CaCO_3$/liter/minute/(gram/liter) [6 grains/gallon/minute/(gram/gallon)], based on calcium ion hardness.

Optimum aluminosilicates for builder purposes exhibit a calcium ion exchange rate of at least 260 mg equivalent of $CaCO_3$/liter/ minute/(gram/liter) [4 grains/gallon/minute/(gram/gallon)].

Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669.

Preferred synthetic crystalline aluminosilicate ion exchange materials useful herein are available under the designations Zeolite A, Zeolite B, Zeolite X, Zeolite HS, Zeolite MAP and mixtures thereof. In an especially preferred embodiment, the crystalline aluminosilicate ion exchange material is Zeolite A and has the formula $$Na_{12}[(AlO_2)_{12}(SiO_2)_{12}].xH_2O$$

wherein x is from 20 to 30, especially 27. Zeolite X of formula $Na_{86}[(AlO_2)_{86}(SiO_2)_{106}]$. 276 $H_2O$ is also suitable, as well as Zeolite HS of formula $Na_6[(AlO_2)_6(SiO_2)_6]$ $7.5H_2O$).

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The logarithmic acidity constant is defined by reference to the equilibrium $$H^+ + A^- \rightleftharpoons HA$$

where A— is the fully ionized carboxylate anion of the builder salt.

The equilibrium constant is therefore $$K_1 = \frac{(HA)}{(H^+)(A^-)}$$

and $pK_1 = \log_{10}K$.

For the purposes of this specification, acidity constants are defined at 25° C. and at zero ionic strength. Literature values are taken where possible (see Stability Constants of Metal-Ion Complexes, Special Publication No. 25, The Chemical Society, London): where doubt arises they are determined by potentiometric titration using a glass electrode.

Preferred carboxylates can also be defined in terms of their calcium ion stability constant ($pK_{Ca}$++) defined, analogously to $pK_1$, by the equations $$pK_{Ca^{++}} = \log 10K_{Ca^{++}}$$

$$\text{where} K_{Ca^{++}} = \frac{(Ca^{++}A)}{(Ca^{++})(A)}$$

Preferably, the polycarboxylate has a $pK_{Ca++}$ in the range from about 2 to about 7 especially from about 3 to about 6. Once again literature values of stability constant are taken where possible. The stability constant is defined at 25° C. and at zero ionic strength using a glass electrode method of measurement as described in Complexation in Analytical Chemistry by Anders Ringbom (1963).

The carboxylate or polycarboxylate builder can be momomeric or oligomeric in type although monomeric polycarboxylates are generally preferred for reasons of cost and performance.

Monomeric and oligomeric builders can be selected from acyclic, alicyclic, heterocyclic and aromatic carboxylates having the general formulae

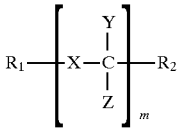

(a)

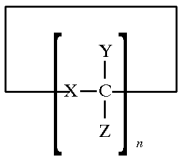

(b)

or

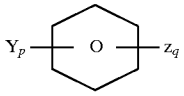

(c)

wherein $R_1$ represents H,$C_{1-30}$ alkyl or alkenyl optionally substituted by hydroxy, carboxy, sulfo or phosphono groups or attached to a polyethylenoxy moiety containing up to 20 ethyleneoxy groups; $R_2$ represents H,$C_{1-4}$ alkyl, alkenyl or hydroxy alkyl, or alkaryl, sulfo, or phosphono groups;

X represents a single bond; O; S; SO; $SO_2$; or $NR_1$;

Y represents H; carboxy;hydroxy; carboxymethyloxy; or $C_{1-30}$ alkyl or alkenyl optionally substituted by hydroxy or carboxy groups;

Z represents H; or carboxy;

m is an integer from 1 to 10;

n is an integer from 3 to 6;

p, q are integers from 0 to 6, p+q being from 1 to 6; and wherein, X, Y, and Z each have the same or different representations when repeated in a given molecular formula, and wherein at least one Y or Z in a molecule contain a carboxyl group.

Suitable carboxylates containing one carboxy group include lactic acid, glycolic acid and ether derivatives thereof as disclosed in Belgian Patent Nos. 831 368, 821 369 and 821 370.

Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2 446 686, and 2 446 687 and U.S. Pat. No. 3,935,257 and the sulfinyl carboxylates described in Belgian Patent No. 840 623. Polycarboxylates containing three carboxy groups include, in particular, water-soluble citrates, aconitrates and citraconates as well as succinate derivatives such as the carboxymethyloxysuccinates described in British Patent No. 1 379 241, lactoxysuccinates described in British Patent No. 1 389 732, and aminosuccinates described in Netherlands Application 7 205 873, and the oxypolycarboxylate materials such as 2-oxa-1,1,3-propane tricarboxylates described in British Patent No. 1 387 447.

Polycarboxylates containing four carboxy groups include oxydisuccinates disclosed in British Patent No. 1 261 829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1 398 421 and 1 398 422 and in U.S. Pat. No. 3,936,448, and the sulfonated pyrolysed citrates described in British Patent No. 1 439 000.

Alicyclic and heterocyclic polycarboxylates include cyclopentane-cis, cis, cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1 425 343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1 596 756. Examples of such salts are polyacrylates of MWt 2000–5000 and their copolymers with maleic anhydride, such copolymers having a molecular weight of from 20 000 to 100 000, especially from 70 000 to 90 000. These materials are normally used at levels of from 0.5% to 10% by weight more preferably from 0.75% to 8%, most preferably from 1% to 6% by weight of the composition.

Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene triamine penta methylene phosphonates, although these materials are less preferred where the minimisation of phosphorus compounds in the compositions is desired.

These phosphonate materials are normally present at levels less than 5% by weight, more preferably less than 3% by weight and most preferably less than 1% by weight of the compositions.

In the concentrated detergent compositions of the present invention it is preferred that water-soluble sulfate, particularly sodium sulfate, should be present at a level of not more than 5% and preferably at a level of not more than 2.5% by weight. of the composition. Preferably no sodium sulfate is added as a separate ingredient and its incorporation as a by-product e.g. with the sulfated surfactants, should be minimised.

The particulate components can also include miscellaneous ingredients preferably in a total amount of from 0% to 45% by weight, examples of such ingredients being optical brighteners, anti-redeposition agents, photoactivated bleaches (such as tetrasulfonated zinc phthalocyanine) and heavy metal sequestering agents. Where one or more of the particulate components is a spray dried powder it will normally be dried to a moisture content of from 7% to 11% by weight, more preferably from 8% to 10% by weight of the spray dried powder. Moisture contents of powders produced by other processes such as agglomeration may be lower and can be in the range 1–10% by weight.

The particle size of any particulate components is conventional and preferably not more than 5% by weight should be above 1.4 mm, while not more than 10% by weight should be less than 0.15 mm in maximum dimension. Preferably at least 60%, and most preferably at least 80%, by weight of the powder lies between 0.7 mm and 0.25 mm in size.

Preferred detergent compositions in accordance with the invention comprise at least one spray dried granular surfactant-containing particulate component and at least one surfactant-containing particulate agglomerate component.

For spray dried powders, the bulk density of the particles from the spray drying tower is conventionally in the range from 400 to 450 g/liter and this is then enhanced by further processing steps such as size reduction in a high speed cutter/mixer followed by compaction preferably to achieve a final density of greater than 550 g/liter. Alternatively, processes other than spray drying may be used to form a high density particulate directly.

Where the particulate components are particulate agglomerates the bulk density of these components will be a function of their mode of preparation. However, the preferred form of such components is a mechanically mixed agglomerate which may be made by adding the ingredients dry or with an agglomerating agent to a pan agglomerator, Z blade mixer or more preferably an in-line mixer such as those manufactured by Schugi (Holland) BV, 29 Chroomstraat 8211 AS, Lelystad, Netherlands and Gebruder Lodige MaschinenbanGmbH, D-4790 Paderborn 1, Elsenerstrasse 7-9, Postfach 2050 F.R.G. By this means the second component can be given a bulk density in the range from 650 g/liter to 1190 g/liter more preferably from 700 g/liter to 850 g/liter.

Preferably any particulate agglomerate components include sodium carbonate at a level of from 20% to 40% by weight of the component.

Preferably, the composition includes from 3% to 18% sodium carbonate by weight of the composition, more preferably from 5% to 15% by weight.

A highly preferred ingredient of any particulate agglomerate components is also a hydrated water insoluble aluminosilicate ion exchange material of the synthetic zeolite type, described hereinbefore, present at from 10% to 55% by weight of the second component. The amount of water insoluble aluminosilicate material incorporated in this way is from 1% to 15% by weight of the composition, more preferably from 2% to 10% by weight.

In one process for preparing the particulate agglomerate component, the surfactant salt is formed in situ in an inline mixer. The liquid acid form of the surfactant is added to a mixture of particulate anhydrous sodium carbonate and hydrated sodium aluminosilicate in a continuous high speed blender, such as a Lodige KM mixer, and neutralised to form the surfactant salt whilst maintaining the particulate nature of the mixture.

The resultant agglomerated mixture forms the second component which is then added to other components of the product. In a variant of this process, the surfactant salt is pre-neutralised and added as a viscous paste to the mixture of the other ingredients. In the variant, the mixer serves merely to agglomerate the ingredients to form the second component.

Preferred compositions in accordance with the invention comprise one or more multi-ingredient particulate components which may contain one or more additional surfactants which may be water-soluble. These surfactants may be anionic, nonionic, cationic or semipolar in type.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981.

Preferably the granular detergent compositions in accordance with the invention will comprise from 2% to 9% additional nonionic surfactant by weight of the total detergent composition. Additional nonionic surfactant is an especially preferred component of the detergent compositions in accord with the invention when the total level of anionic surfactant is from 5% to 15% by weight of the composition.

One class of nonionic surfactants useful in the present invention comprises condensates of ethylene oxide with a hydrophobic moiety, providing surfactants having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred additional nonionic surfactants of this type are the $C_{12}$–$C_{20}$ primary alcohol ethoxylates containing an average of from 3–11 moles of ethylene oxide per mole of alcohol, particularly the $C_{12}$–$C_{15}$ primary alcohol ethoxylates containing an average of from 3–7 moles of ethylene oxide per mole of alcohol and most preferably the $C_{12}$–$C_{15}$ primary alcohol ethoxylates containing an average of 3 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent compositions are disclosed in EP-B 0 070 074, 0 070 077, 0 075 996 and 0 094 118.

A further class of surfactants are the semi-polar surfactants such as amine oxides. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are substituted by methyl, hydroxyethyl or hydroxpropyl groups.

Cationic surfactants can also be used in the detergent compositions herein and suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl groups.

The particulate components may have any suitable physical form, i.e. it may take the form of flakes, prills, marumes, noodles, ribbons, or granules which may be spray-dried or non spray-dried agglomerates.

Although any further component could in theory comprise a water-soluble surfactant on its own, in practice at least one organic or inorganic salt is included to facilitate processing. This provides a degree of crystallinity, and hence acceptable flow characteristics, to the particulate and may be any one or more of the organic or inorganic salts present in the first component.

Where there is only one surfactant-containing component in the composition one or more other ingredients will be added as particulate components and will preferably also be present where more than one surfactant-containing particulate components forms part of the composition. Thus one or more of oxygen bleaches, photoactivated bleaches, bleach activators, builder salts, detergent enzymes, suds suppressors, fabric softening agents, soil suspension and anti-redeposition agents, soil release polymers, and optical brighteners can be added as solids to one or more surfactant-containing particulate components.

Suitable oxygen bleaches include the inorganic perhydrates such as sodium perborate monohydrate and tetrahydrate, sodium percarbonate, sodium perphosphate and sodium persilicate. Sodium percarbonate and the sodium perborate salts are most preferred. These materials are normally added as crystalline solids and, in the case of sodium percarbonate, may be coated with e.g. silicate in order to aid stability. Usage levels range from 3% to 40% by weight, more preferably from 5% to 30% by weight.

Photoactivated bleaches include the zinc and aluminium salts of tri and tetra sulfonated phthalocyanine which are normally added as dispersions in other materials because of their low levels of usage, typically from 0.0005 to 0.01% by weight of the composition.

Bleach activators or peroxy acid bleach precursors can be selected from a wide range of classes and are preferably those containing one or more N- or O- acyl groups.

Suitable classes include anhydrides, esters, imides and acylated derivatives of imidazoles and oximes, and examples of useful materials within these classes are disclosed in GB-A-1586789. The most preferred classes are esters such as are disclosed in GB-A-836 988, 864 798, 1 147 871 and 2 143 231 and imides such as are disclosed in GB-A-855 735 & 1 246 338. Levels of incorporation range from 1% to 10% more generally from 2% to 6% by weight of the composition.

Particularly preferred precursor compounds are the N-,N, $N^1N^1$ tetra acetylated compounds of formula

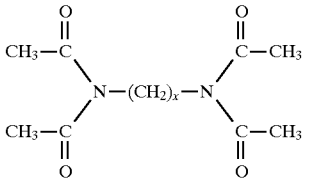

wherein x can be O or an integer between 1 & 6.

Examples include tetra acetyl methylene diamine (TAMD) in which x=1, tetra acetyl ethylene diamine (TAED) in which x=2 and tetraacetyl hexylene diamine (TAHD) in which x=6. These and analogous compounds are described in GB-A-907 356. The most preferred peroxyacid bleach precursor is TAED.

Solid peroxyacid bleach precursors useful in compositions of the present invention have a Mpt>30° C. and preferably >40° C. Such precursors will normally be in fine powder or crystalline form in which at least 90% by weight of the powder has a particle size >150 micrometers.

This powder is usually agglomerated to form particulate material, at least 85% of which has a particle size between 400 and 1700 micrometers. Suitable agglomerating agents include aliphatic mono and polycarboxylic acids, $C_{12}$–$C_{18}$ aliphatic alcohols condensed with from 10 to 80 moles of ethylene oxide per mole of alcohol, cellulose derivatives such as methyl, carboxymethyl and hydroxyethyl cellulose, polyethylene glycols of MWt 4,000–10,000 and polymeric materials such as polyvinyl pyrrolidone.

The precursors are preferably coated with an organic acid compound such as citric or glycolic acid, as disclosed in he commonly assigned copending British Patent Application No. 9102507.2 filed Feb. 6, 1991.

Builder salts that can advantageously be added as solid particulates include silicates and certain polycarboxylate builders such as citrates.

Dry mix addition of amorphous sodium silicates, particularly those of $SiO_2$:$Na_2O$ ratio of from 1.0:1 to 3.2:1 is employed where aluminosilicates form part of a spray dried component, in order to avoid the formation of insoluble reaction products. Furthermore the incorporation of crystalline, so called 'layered' silicates into detergent compositions necessitates their addition as solids.

These crystalline layered sodium silicates have the general formula $$NaMSi_xO_{2x}+1.^yH_2O$$

wherein M is sodium or hydrogen, x is a number from 1.9 to 4 and y is a number from 0 to 20. Crystalline layered sodium silicates of this types are disclosed in EP-A-0 164 514 and methods for their preparation are disclosed in DE-A-3 417 649 and DE-A-3 742 043. For the purposes of the present invention, x in the general formula above has a value of 2, 3 or 4 and is preferably 2. More preferably M is sodium and y is 0 and preferred examples of this formula comprise the γ and δ forms of $Na_2Si_2O_5$. These materials are available from Hoechst AG FRG as respectively NaSKS-11 and NaSKS-6. The most preferred material is δ-$Na_2Si_2O_5$, (NaSKS-6). Crystalline layered silicates are incorporated either as dry mixed solids, or as solid components of agglomerates with other components.

Anti-redeposition and soil-suspension agents suitable herein include cellulose derivatives such as methylcellulose, carboxymethylcellulose and hydroxyethycellulose, and homo- or co-polymeric polycarboxylic acids or their salts. Polymers of this type include copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Preferred optical brighteners are anionic in character, examples of which are disodium $4,4^1$-bis-(2-diethanolamino-4-anilino -s- triazin-6-ylamino)stilbene-$2:2^1$ disulphonate, disodium $4,4^1$-bis-(2-morpholino -4-anilino-2-triazin-6-ylaminostilbene-$2:2^1$-disulphonate, disodium 4, $4^1$-bis-(2,4-dianilino-s-triazin-6-ylamino) stilbene-$2:2^1$- disulphonate, monosodium $4^1$,$4^{11}$-bis-(2,4-dianilino-s-triazin-6 ylamino) stilbene-2-sulphonate, disodium $4,4^1$-bis-(2-anilino-4-(N-methyl-N-2-hydroxyethylamino)-2-triazin-6-ylamino) stilbene-$2,2^1$ -disulphonate, disodium $4,4^1$-bis-(4-phenyl-2,1,3-triazol-2-yl)stilbene-$2,2^1$ disulphonate, disodium $4,4^1$bis(2-anilino-4-(1-methyl-2-hydroxyethylamino)-s-triazin-6-ylamino) stilbene-$2,2^1$disulphonate and sodium 2(stilbyl-$4^{11}$-(naphtho-$1^1,2^1$:4,5)-1,2,3 - triazole-$2^{11}$- sulphonate.

Soil-release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4 116 885 and 4 711 730 and European Published Patent Application No. 0 272 033. A particular preferred polymer in accordance with EP-A-0 272 033 has the formula $(CH_3(PEG)_{43})_{0.75}(POH)_{0.25}(T\text{-}PO)_{2.8}(T\text{-}PEG)_{0.4})T(PO\text{-}H)_{0.25}((PEG)_{43}CH_3)_{0.75}$ where PEG is —$(OC_2H_4)O$—,PO is $(OC_3H_6O)$ and T is $(pCOC_6H_4CO)$.

Certain polymeric materials such as polyvinyl pyrrolidones typically of MWt5000–20000, preferably 10000–15000, also form useful agents in preventing the transfer of labile dyestuffs between fabrics during the washing process.

Another optional ingredient useful in the present invention is one or more enzymes.

Preferred enzymatic materials include the commercially available amylases, neutral and alkaline proteases, lipases, esterases and cellulases conventionally incorporated into detergent compositions. Suitable enzymes are discussed in U.S. Pat. Nos. 3,519,570 and 3,533,139.

Fabric softening agents can also be incorporated into detergent compositions in accordance with the present invention. These agents may be inorganic or organic in type. Inorganic softening agents are exemplified by the smectite clays disclosed in GB-A-1 400 898. Organic fabric softening agents include the water insoluble tertiary amines as disclosed in GB-A-1 514 276 and EP-B-0 011 340.

Their combination with mono $C_{12}$–$C_{14}$ quaternary ammonium salts is disclosed in EP-B-0 026 527 & 0 026 528. Other useful organic fabric softening agents are the dilong chain amides as disclosed in EP-B-0 242 919. Additional organic ingredients of fabric softening systems include high molecular weight polyethylene oxide materials as disclosed in EP-A-0 299 575 and 0 313 146.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight. Where a portion of the composition is spray dried, these materials can be added to the aqueous slurry fed to the spray drying tower, although in some instances it may be more convenient to add them as a dry mixed particulate, or spray them as a molten liquid on to other solid components of the composition.

The granular compositions of the present invention preferably have a bulk density of at least 550 g/liter, preferably at least 650 g/liter more usually about 700 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement e.g. a knife, across its upper edge. The filled cup is then weighed and the value obtained for the weight of powder doubled to provide the bulk density in g/liter. Replicate measurements are made as required.

Subject to the above bulk density limitations, the compositions of the invention can be made via a variety of methods including dry mixing, spray drying, agglomeration and granulation. A preferred method of making the compositions involves a combination of spray drying, agglomeration in a high speed mixer and dry mixing.

The granular compositions in accordance with the present invention preferably comprise a plurality of separate particulate components. The particulates can have any suitable form such as granules, flakes, prills, marumes or noodles but are preferably granular. The granules themselves may be agglomerates formed by pan or drum agglomeration or by an in-line mixer and also may be spray dried particles produced by atomising an aqueous slurry of the ingredients in a hot air stream which removes most of the water. The spray dried granules are then subjected to densification steps, e.g. by high speed cutter mixers and/or compacting mills, to increase density before being reagglomerated.

Preferred compositions in accordance with the invention comprise at least one spray dried granular surfactant-containing component and at least one surfactant-containing particulate agglomerate component.

Where one or more surfactant-containing particulate components are spray dried granules these will preferably comprise in total at least 15%, more preferably from 25% to 45%, by weight of the composition. Where one or more surfactant-containing particulate components are particulate agglomerates these will preferably comprise in total from 1% to 50%, more preferably from 10% to 40% by weight of the composition.

Where the surfactant-containing particulates are the only multi ingredient components, the remainder of the ingredients can be added individually as dry solids, or can be sprayed on to either the particulate components or on to any or all of the solid ingredients.

In a particularly preferred process for making detergent compositions in accordance with the invention, part of the spray dried product comprising one of the granular components is diverted and subjected to a low level of nonionic surfactant spray on before being reblended with the remainder. A second granular component is made using the preferred process described above. The first and second components together with perhydrate bleach, bleach precursor particulate, other dry mix ingredients such as any carboxylate chelating agent, soil-release polymer, silicate of conventional or crystalline layered type, and enzyme are then fed to a conveyor belt, from which they are transferred to a horizontally rotating drum in which perfume and silicone suds suppressor are sprayed on to the product. In highly preferred compositions, a further drum mixing step is employed in which a low (approx. 2% by weight) level of finely divided crystalline material is introduced to increase density and improve granular flow characteristics.

In preferred concentrated detergent products incorporating an alkali metal percarbonate as the perhydrate salt it has been found necessary to control several aspects of the product such as its heavy metal ion content and its equilibrium relative humidity.

The detergent compositions of the invention may be used with delivery systems that provide transient localised high concentrations of product in the drum of an automatic washing machine at the start of the wash cycle. These delivery systems avoid problems associated with loss of product in the pipework or sump of the machine and the high transient concentrations provide fabric cleaning benefits.

High transient concentrations require rapid dissolution/dispersion of the composition but this is difficult with surfactant containing particulate components in which the one or more primary anionic or nonionic surfactants are relatively insoluble and hence make the component hydrophobic in nature. The incorporation of a low level of a water soluble $C_{11}$–$C_{18}$ alkyl ethoxysulfate material into the primary anionic or nonionic surfactant-containing particulate has however been found to enable acceptable rate of dissolution characteristics to be achieved whilst retaining the detergency provided by the primary anionic or nonionic surfactants.

Delivery systems for introducing the compositions of the invention into an automatic washing machine can take a number of forms. Thus a composition can be incorporated in a bag or container from which it is rapidly releasable at the start of the wash cycle in response to agitation, a rise in temperature or immersion in the wash water in the drum.

Alternatively the washing machine itself may be adapted to permit direct addition of the composition to the drum e.g. by a dispensing arrangement in the access door.

Products comprising a detergent composition enclosed in a bag or container are usually designed in such a way that container integrity is maintained in the dry state to prevent egress of the contents when dry, but are adapted for release of the container contents on exposure to a washing environment, normally on immersion in an aqueous solution.

Usually the container will be flexible, such as a bag or pouch. The bag may be of fibrous construction coated with a water impermeable protective material so as to retain the contents, such as is disclosed in European published Patent Application No. 0 018 678. Alternatively it may be formed of a water-insoluble synthetic polymeric material provided with an edge seal or closure designed to rupture in aqueous media as disclosed in European published Patent Application Nos. 0 011 500, 0 011 501, 0 011 502, and 0 011 968. A convenient form of water frangible closure comprises a water soluble adhesive disposed along and sealing one edge of a pouch formed of a water impermeable polymeric film such as polyethylene or polypropylene. In a variant of the bag or container form, laminated sheet products can be employed in which a central flexible layer is impregnated and/or coated with a composition and then one or more outer layers are applied to produce a fabric-like aesthetic effect. The layers may be sealed together so as to remain attached during use or may separate on contact with water to facilitate the release of the coated or impregnated material.

An alternative laminate form comprises one layer embossed or deformed to provide a series of pouch-like containers into each of which the detergent components are deposited in measured amounts, with a second layer overlying the first layer and sealed thereto in those areas between the pouch-like containers where the two layers are in contact. The components may be deposited in particulate, paste or molten form and the laminate layers should prevent egress of the contents of the pouch-like containers prior to their addition to water. The layers may separate or may remain attached together on contact with water, the only requirement being that the structure should permit rapid release of the contents of the pouch-like containers into solution. The number of pouch-like containers per unit area of substrate is a matter of choice but will normally vary between 500 and 25,000 per square meter.

Suitable materials which can be used for the flexible laminate layers in this aspect of the invention include, among others, sponges, paper and woven and non-woven fabrics.

However the preferred means of carrying out the process of the invention is to introduce the composition into the liquid surrounding the fabrics that are in the drum via a reusable dispensing device having walls that are permeable to liquid but impermeable to the solid composition.

Devices of this kind are disclosed in European Patent Application Publication Nos. 0 343 069 & 0 343 070. The latter Application discloses a device comprising a flexible sheath in the form of a bag extending from a support ring defining an orifice, the orifice being adapted to admit to the bag sufficient product for one washing cycle of an automatic process. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

Preferred dispensing devices are reusable and are designed in such a way that container integrity is maintained in both the dry state and during the wash cycle. Especially preferred dispensing devices for use in accord with the invention have been described in the following patents; GB-B-2,157, 717, GB-B-2, 157, 718, EP-A-0201376, EP-A-0288345 and EP-A-0288346. An article by J. Bland published in Manufacturing Chemist, November 1989, pages 41–46 also describes especially preferred dispensing devices for use with granular laundry products which are of a type commonly known as the "granulette".

The invention is illustrated in the following non limiting Examples, in which all percentages are on a weight basis unless otherwise stated.

In the detergent compositions, the abbreviated component identifications have the following meanings:

45AS:Sodium $C_{14}$–$C_{15}$ alkyl sulfate

25AE3S:$C_{12}$–$C_{15}$ alkyl ethoxysulfate containing an average of three ethoxy groups per mole $TAE_n$:Tallow alcohol ethoxylated with n moles of ethylene oxide per mole of alcohol 35E7:A $C_{13\text{-}15}$ primary alcohol condensed with an average of 7 moles of ethylene oxide Silicate:Amorphous Sodium Silicate ($SiO_2$:$Na_2O$ ratio normally follows)

Carbonate:Anhydrous sodium carbonate

Bicarbonate:Anhydrous sodium bicarbonate

Zeolite A:Hydrated Sodium Aluminosilicate of formula $Na_{12}(A1O_2SiO_2)_{12}.27H_2O$ having a primary particle size in the range from 1 to 10 micrometers Citrate:Tri-sodium citrate dihydrate MA/AA:Copolymer of 1:4 maleic/acrylic acid, average molecular weight about 80,000.

Enzyme:Mixed proteolytic and amylolytic enzyme sold by Novo Industries AS.

EXAMPLE 1

The following low-sudsing granular detergent composition was prepared in accordance with the invention (percentage, parts by weight).

| | A |
|---|---|
| 45AS | 8.8 |
| 25AE3S | 2.2 |
| 35E7 | 4.5 |
| Zeolite A | 24.8 |
| Carbonate | 15.5 |

-continued

| | A |
|---|---|
| MA/AA | 4.6 |
| Sulphate | 5.0 |
| Silicate | 2.5 |
| Citrate | 11.4 |
| Bicarbonate | 7.0 |
| Enzyme | 1.6 |
| Suds suppressor system | |
| Particulate antifoam component | 2.1 |
| Spray-on antifoam component | 2.0 |
| Misc, minors, moisture to balance | |

The particulate antifoam component was an agglomerate comprising 11% by weight of the component of polydimethylsiloxane, 14% by weight TAE80, 5% by weight of a mixture of $C_{12}$–$C_{22}$ hydrogenated fatty acids and 70% by weight of starch.

The spray-on antifoam component comprised 30% by weight of the component of silicone/silica antifoam compound comprising 85% by weight of the antifoam compound of polydimethylsiloxane and 15% by weight of the antifoam compound of silica, 3% by weight of silicone glycol rake copolymer (DCO544 from DOW Corning), and 67% by weight of TAE11 carrier fluid.

We claim:

1. A granular laundry detergent composition comprising:

A) from about 3% to about 30% by weight, of a detersive surfactant said detersive surfactant contains from 40% to 95% by weight, a mixture of a $C_{12}$–$C_{20}$ alkyl sulfate surfactant and a $C_{11}$–$C_{18}$ alkyl ethoxysulfate having an average of form 1 to 7 ethoxy groups per mole wherein the ratio of alkyl sulfate to alkyl ethoxysulfate surfactant is from about 2:1 to about 19:1;

B) from about 0.05% to about 20% by weight, of a spray-on suds suppressing component comprising:

a) from about 5% to about 50% by weight, of a silicone antifoam component comprising:

i) from about 50% to about 99% by weight, a polydimethyl siloxane;

ii) from about 1% to about 50% by weight, of silica;

b) from about 0.5% to about 10% by weight, of a silicone glycol rake copolymer dispersant having polyoxyalkylene content of from about 72% to about 78% and an ethylene oxide to propylene oxide ratio of from about 1:0.9 to about 1:1.1;

c) from about 5% to about 80% by weight, of a $C_{16}$–$C_{18}$ ethoxyalcohol carrier having a degree of ethoxylation of from about 5 to about 50;

wherein said spray-on component is incorporated into said granular detergent composition by spraying said spray-on component on to one or more of the granular detergent components which comprise said granular detergent composition;

C) from about 0.05% to about 20% by weight, of a particulate component comprising:

a) from about 8% to about 15% by weight, of a mixture of polydimethyl siloxane and silica;

b) from about 60% to about 80% by weight, of a starch carrier;

c) from about 5% to about 20% by weight, of a $C_{16}$–$C_{18}$ ethoxyalcohol agglomerate binder having a degree of ethoxylation of from about 5 to about 50;

d) from 1% to about 10% by weight of a $C_{12}$–$C_{22}$ hydrogenated fatty acid; and D) the balance carriers and adjunct ingredients, said adjunct ingredients selected from the group consisting of builders, bleaches, bleach activators, brighteners, enzymes, soil release agents, softening agents, and mixtures thereof.

* * * * *